United States Patent [19]

Fujitani et al.

[11] Patent Number: 4,884,956

[45] Date of Patent: Dec. 5, 1989

[54] ROTARY COMPRESSOR WITH CLEARANCE VOLUMES TO OFFSET PULSATIONS

[75] Inventors: Makoto Fujitani; Masashi Hirabayashi, both of Nagoya; Hideo Honda; Hiroshi Machida, both of Nishi Kasugai; Masami Kondo; Sachio Onoda, both of Nagoya, all of Japan

[73] Assignees: Mitsubishi Jukogyo Kabushiki Kaisha, Tokyo; Churyo Engineering Kabushiki Kaishi, Aichi, both of Japan

[21] Appl. No.: 140,237

[22] Filed: Dec. 31, 1987

[30] Foreign Application Priority Data

Jan. 20, 1987 [JP] Japan ..... 62-10681

[51] Int. Cl.[4] ..... F04C 18/356; F04C 29/06

[52] U.S. Cl. ..... 418/15; 418/63; 418/75; 418/150; 418/181; 417/312

[58] Field of Search ..... 418/15, 63–67, 418/75, 79, 150, 181, 243–251; 417/312

[56] References Cited

U.S. PATENT DOCUMENTS

| | | | |
|---|---|---|---|
| 4,204,816 | 5/1980 | Bein . | |
| 4,537,567 | 8/1985 | Kawaguchi et al. | 418/63 |
| 4,730,996 | 3/1988 | Akatsuchi et al. | 418/63 |

FOREIGN PATENT DOCUMENTS

| | | | |
|---|---|---|---|
| 2127546 | 12/1972 | Fed. Rep. of Germany . | |
| 3113233 | 12/1982 | Fed. Rep. of Germany . | |
| 2376957 | 8/1978 | France . | |
| 57-153795 | 9/1982 | Japan | 418/63 |
| 59-3198 | 1/1984 | Japan . | |
| 59-30581 | 2/1984 | Japan . | |
| 59-99088 | 6/1984 | Japan . | |
| 59-103985 | 6/1984 | Japan . | |
| 59-141787 | 8/1984 | Japan . | |
| 59-158396 | 9/1984 | Japan . | |
| 61-232398 | 10/1986 | Japan | 418/15 |

OTHER PUBLICATIONS

Analysis of Hermetic Rolling Piston Type Compressor Noise, and Counter-Measures, by Kiyoshi Sano et al., pp. 242–250.

*Primary Examiner*—John J. Vrablik

*Attorney, Agent, or Firm*—Wenderoth, Lind & Ponack

[57] ABSTRACT

A rotary compressor includes a top clearance volume formed between a cylinder chamber and at least one delivery valve. Another top clearance volume, in communication with the cylinder chamber, produces a reverse flow of compressed fluid which generates pulsations adapted to offset a high frequency component of pulsations generated in the cylinder chamber by compressed fluid reversely flowing from the first top clearance volume to the cylinder chamber. Thereby the high frequency component of pulsations generated in the cylinder chamber is eliminated, and a low-noise rotary compressor is provided.

7 Claims, 6 Drawing Sheets

ROTARY COMPRESSOR WITH CLEARANCE VOLUMES TO OFFSET PULSATIONS

BACKGROUND OF THE INVENTION

1. Field of the Invention

The present invention relates to improvements in a rotary compressor that is available as a refrigerant compressor for use in refrigeration or air-conditioning or the like, and more particularly to reduction of noise in such rotary compressor.

2. Description of the Prior Art

At first, description will be made of a rotary compressor in the prior art, by way of example, in connection with a refrigerant compressor for use in refrigeration or air-conditioning, with reference to FIGS. 9 to 15. In these figures, reference numeral 1 designates a tightly closed housing, and at the top of this housing is provided a delivery pipe 2 for leading compressed refrigerant gas within the housing to the outside. To this delivery pipe 2 are successively connected a condenser 4, a throttling mechanism 5, an evaporator 6 and an accumulator 7 via refrigerant pipings 3, and the accumulator 7 is communicated with a cylinder chamber 20 within the tightly closed housing 1 via a suction pipe 8. Reference numeral 9 designates an inlet portion of the suction pipe 8 within the accumulator 7. A gaseous refrigerant sucked from the inlet portion 9 through the suction pipe 8 into the cylinder chamber 20 is compressed, then it is delivered into a delivery cavity 13 through a delivery port 34 and a delivery valve 42, and thereafter it is led out to a space portion 14 within the tightly closed housing 1, passed around a motor 11 and delivered to the outside of the tightly closed housing 1 through the delivery pipe 2.

Reference numeral 12 designates a crank shaft and numeral 15 designates lubricating oil kept at the bottom of the tightly closed housing. Reference numeral 30 designates a cylinder main body fixedly secured to the lower portion of the tightly closed housing 1. At the upper and lower ends of the cylinder main body 30 are fixedly secured by bolts an upper bearing 40 and a lower bearing 41, respectively, which rotatably support the crank shaft 12, and thereby the tightly closed cylinder camber 20 is formed. Within the cylinder chamber 20 is disposed a rotor 31 loosely fitted on an eccentric portion of the crank shaft 12, and this cylinder chamber 20 is partitioned into a suction side space **20*a* communicating with the suction pipe 8 and a compression side space 20*b* by means of a partition plate 32 which is slidably fitted in a groove provided in the cylinder main body 30 so that the tip end of the partition plate 32 on the side of the cylinder chamber 20 may be pressed against the outer circumferential surface of the rotor 31**.

The above-mentioned delivery port 34 is provided in the upper bearing 40 contiguously to the partition plate 32 so as to communicate with the compression side space **20*b*, and to this delivery port 34 is mounted delivery valve 42 via a retainer 43 and a bolt 44. Reference numeral 33 designates a notched groove provided in the cylinder 30 for the purpose of ensuring that a portion of a cross-sectional area of the passageway between the delivery port 34 and the cylinder chamber 20 is open, and compressed gas is adapted to be delivered from this notched groove 33 through the delivery port 34**.

In the rotary compressor having the abovementioned construction, while refrigerant gas at a low pressure is being sucked through the suction pipe 8 into the suction side space **20*a*, the gas sucked during the preceding rotation is compressed in the compression side space 20*b*, the volume of which is being reduced as the rotor 31 rotates, and thereafter the gas is passed through the notched groove 33 and the delivery port 34 and delivered through the delivery valve 42. However, the notched groove 33 and the delivery port 34 form a so-called clearance volume, and the gas existing in this space portion will not be delivered through the delivery valve 42. Rather, but after the rotor 31 has passed the top clearance volume portion, such gas will flow reversely into the suction side space 20*a* which is in a suction stroke. Accordingly, if the pressure within this cylinder chamber 20 is measured, it has the behavior as shown in FIG. 12. In FIG. 12, the rotational angle of the rotor is shown along the abscissa, while the pressure within the cylinder chamber is shown along the ordinate, and since the gas in the top clearance volume portion will abruptly flow in the reverse direction into the suction side space 20*a* at a low pressure, a pressure waveform measured in the suction side space 20*a*** will contain pulsations having a high frequency component as shown at A. Therefore, there is a problem in the prior art that due to the influence of these pulsations, the level of noise of a compressor is large.

Hence, in order to prevent these pulsations having a high frequency component, improved structures were invented in the prior art such that a buffer 35 making use of a sound effect as shown in FIGS. 13 and 14 was provided at the top clearance volume portion, or that a removed portion 36, of about several hundred microns in depth was provided from the notched groove 33 up to the suction side space **20*a* so as to leak gas gradually for the purpose of preventing the gas in the top clearance volume from leaking abruptly to the suction side space 20*a* as shown in FIG. 15**.

However, the structure shown in FIGS. 13 and 14 involved the problem that if a part of the lubricating oil sucked into the cylinder during operation should enter the buffer 35 and the volume of the buffer should be filled with the lubricating oil, a sufficient noise reduction effect could not be obtained. On the other hand, the structure shown in FIG. 15 involved the problem that deterioration of performance due to leakage of gas generated when the rotor 31 reached the portion 36 greater than that generated in the case where the portion 36 is not present, was observed, and also, depending upon operating pressure conditions the effect was reduced due to a constant cross-sectional area of the leakage path. Moreover, since the depth of portion 36 was several hundred microns, the structure was associated with difficulties in machining, and in order to maintain the effect for a wide range of operating pressure conditions it was necessary to decrease the depth of the portion 36 and to elongate the length thereof, but this quickened the timing of leakage and would increase deterioration of performance.

In essence, the heretofore known rotary compressors involved the problems that due to abrupt leakage of gas in a top clearance volume into a cylinder space at a low pressure, pulsations having a high frequency component were generated in the cylinder space and noise caused by these pulsations were produced. Even with improved structures proposed for resolving the abovementioned problem, the improvement was not sufficient, and such proposals still involved deterioration of a performance caused by leakage of gas or difficulties in machining.

SUMMARY OF THE INVENTION

It is therefore one object of the present invention to provide an improved rotary compressor that is free from the above-described disadvantages in the prior art.

A more specific object of the present invention is to provide a low noise rotary compressor in which noise caused by pulsations having a high frequency component generated by compressed fluid flowing reversely from a top clearance volume to a cylinder chamber are eliminated or at least largely reduced.

According to one feature of the present invention, there is provided a rotary compressor of the type including a rotor performing rotary motion within a cylinder, and a cylinder chamber formed between the cylinder and the rotor and partitioned by a partition plate into a suction side space and a compression side space. Fluid sucked into the suction side space is compressed and delivered from the compression side space through a delivery valve. Besides a top clearance volume formed between the cylinder chamber and the delivery valve, another top clearance volume, in communication with the cylinder chamber, produces a reverse flow of compressed fluid which generates pulsations adapted to offset a high frequency component of pulsations generated in the cylinder chamber by compressed fluid reversely flowing from the first top clearance volume to the cylinder chamber.

According to another feature of the present invention, the above-mentioned another top clearance volume is provided at such position that it produces a reverse flow of compressed fluid which generates pulsations phase-shifted by one-half cycle with respect to the high frequency component of the pulsations generated by the reverse flow of compressed fluid from the first top clearance volume.

According to the present invention, owing to the improved structure of the rotary compressor as described above, a reverse flow of compressed fluid from the additional top clearance volume into the cylinder chamber is produced, a high frequency component of pulsations generated by this reverse flow serves to offset the high frequency component of the pulsations generated by the compressed fluid flowing reversely from the top clearance volume formed between the cylinder chamber and the delivery valve, and thereby high frequency components of pulsations generated in the cylinder chamber can be eliminated. Therefore, reduction of noise caused by a high frequency component of the above-described pulsations is achieved.

Moreover, since the additional top clearance volume is provided at a displaced position, lubricating oil will not fill the additional top clearance volume. Further, the invention does not result in difficulty in machining. Thus, the effect of the improved structure can be fully revealed without deteriorating the performance of the rotary compressor.

The above-mentioned and other objects, features and advantages of the present invention will become more apparent by reference to the following description of preferred embodiments of the invention taken in conjunction with the accompanying drawings.

DESCRIPTION OF THE PREFERRED EMBODIMENTS

In the following, one preferred embodiment of the present invention will be described with reference to FIGS. 1 to 8.

It is to be noted that in the following description only essential parts of the structure of the preferred embodiment will be explained and the remaining parts of the structure are assumed to be identical to the corresponding parts of the rotary compressor in the prior art as described previously.

Figure 1:
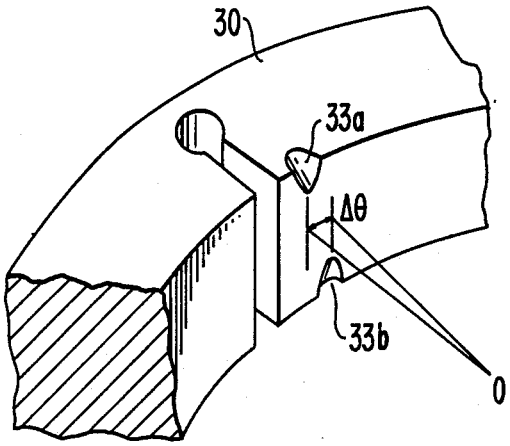
FIGS. 1 to 6 are partial perspective views showing structures of essential parts of different preferred embodiments of the present invention.

The embodiment shown in FIG. 1 is of such type that delivery valves are provided at two locations, i.e. on the upper side and the lower side of a cylinder 30. Two notched grooves **33*a* and 33*b* provided respectively on the opposite sides of the cylinder (that is, in the upper side portion and in the lower side portion) and communicated with the upper and lower delivery valves, respectively, are disposed displaced from each other in the circumferential direction of the cylinder 30. An angle of displacement between these respective notched grooves 33*a* and 33*b*** as viewed from a center axis of the cylinder and represented by $\Delta\theta$ [rad] is chosen to fulfil the following relation:

$$\Delta\theta = \pi \times \Delta t x N/60$$

where $\Delta t$ represents a time period [sec] from one crest to the next crest of a high frequency component of pulsations in a cylinder chamber generated in the beginning of a compression stroke, and N represents a rotational speed [rpm] during operation of the compressor. The construction is such that the notched groove **33*b* and a delivery port communicating therewith may function as another top clearance volume with respect to a top clearance volume formed by the notched groove 33*a*** and a delivery port communicating therewith.

Figure 2:
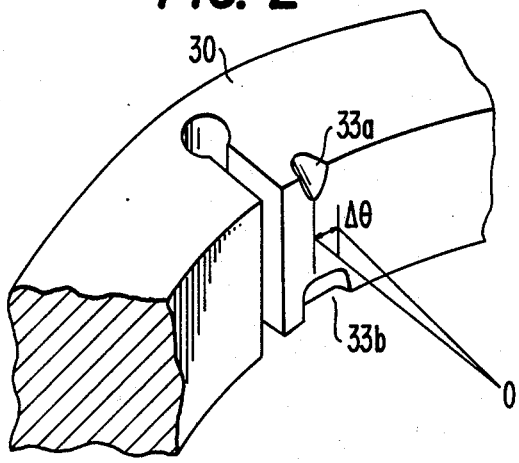

While the embodiment shown in FIG. 1 is of such type that the positions of the upper and lower delivery ports are also displaced by $\Delta\theta$ from each other, modification could be made such that the positions of the upper and lower delivery ports are selected at the same position and the angle of displacement $\Delta\theta$ is realized by broadening the width in the circumferential direction of one notched groove 33*b* as shown in FIG. 2. In other words, with regard to the notched grooves serving as means for shifting timing of leakage by $\Delta\theta$, through it is preferable to dispose notched grooves having the same configuration displaced by $\Delta\theta$ as shown in FIG. 1, a notched groove of different shape such as the notched groove 33*a* shown in FIG. 2 or in FIG. 3 could be employed.

Figure 3:
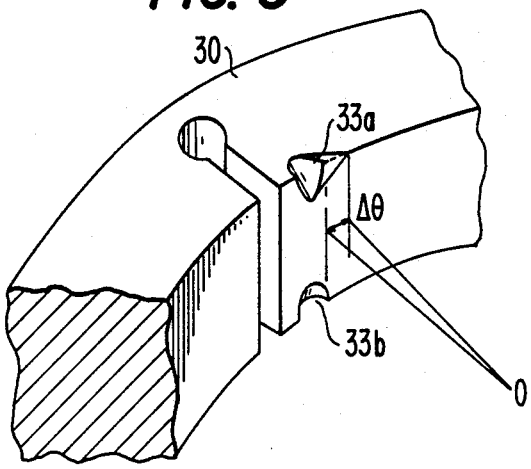

It is to be noted that in the case where the configurations of the two notched grooves are different from each other as is the case with the embodiments shown in FIGS. 2 and 3, though the leakage timing is always shifted by $\Delta\theta$ due to their geometrical configurations, cross-sectional areas of the leakage paths are not identical because of the different shapes of the notched grooves. Especially, in the case of the embodiment shown in FIG. 3, the leakage path cross-sectional area at the beginning of leakage of the notched groove 33*a* is small compared to the leakage path cross-sectional area in the beginning of leakage of the notched groove 33*b*. According to the present invention it is desired to shift a substantial leakage by $\Delta\theta$, that is, by one-half cycle of a high frequency component of the pulsation. Hence, in the case where the configurations of the two notched grooves are not identical to each other, in order to shift a substantial leakage by $\Delta\theta$ it is necessary to determine the displacement angle between the two notched grooves by taking into account the difference in the leakage path cross-sectional areas. For instance, in the embodiment shown in FIG. 3, the displacement angle $\Delta\theta$ between the notched grooves would fall in the following range:

$$\Delta\theta=(1.0\sim2.0)\times\pi\times\Delta t\times N/60$$

Next, description will be made of preferred embodiments in which a delivery valve is provided at one location on one side of a cylinder.

Figure 4:
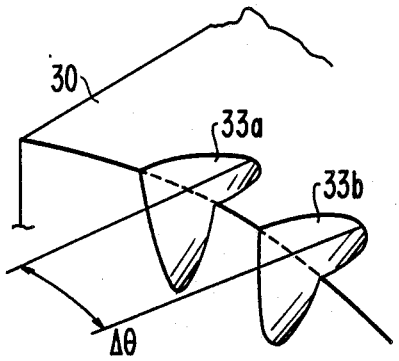

FIG. 4 shows one preferred embodiment of the present invention in which a notched groove 33*b* is provided on the same end side of a cylinder as a notched groove 33*a*, but shifted in position by $\Delta\theta$ in the circumferential direction with respect to the notched groove 33*a* and a delivery port is provided in communication with the notched groove 33*a*. The notched groove 33*b* is provided independently as an additional top clearance volume.

Figure 5:
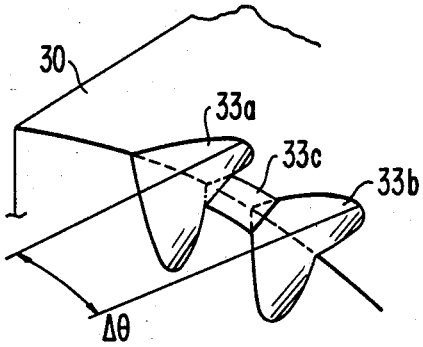
Figure 6:
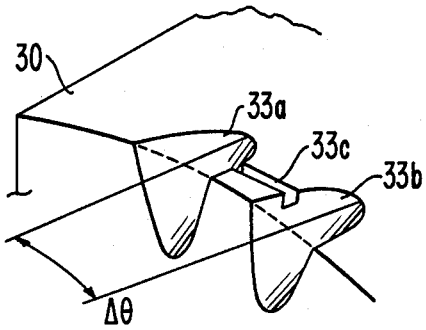
Figure 7:
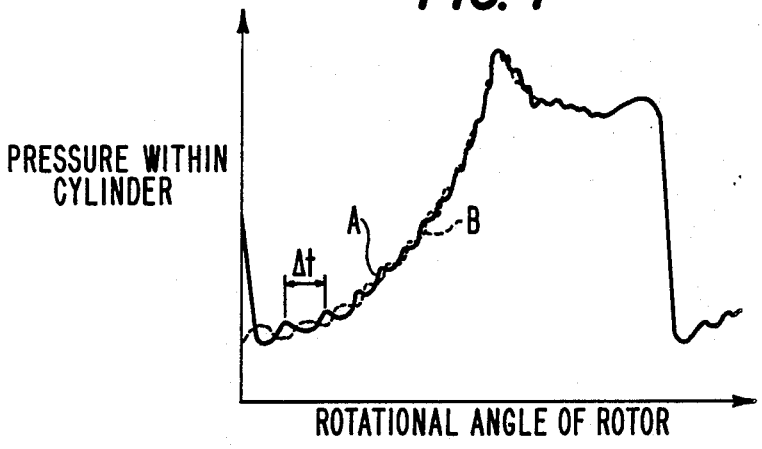
FIG. 7 is a diagram showing variation of pressure within a cylinder as a function of rotational angle of a rotor.

In the embodiment shown in FIG. 4, the top clearance volume formed on the side of the notched groove 33*a* is the sum of the volume of this notched groove 33*a* plus the volume of the delivery port communicated with the notched groove 33*a*. However, if the notched groove 33*b* is provided so as to have the same volume as this sum, then the top clearance volume would be increased and would result in deterioration of performance. Therefore, modification could be made such that volume of the notched groove 33*b* is made nearly equal to the volume of the notched groove 33*a*, a communication groove 33*c* is provided to communicate the respective notched grooves 33*a* and 33*b* with each other as shown in FIG. 5, and thereby the amount of compressed fluid flowing reversely may be divided equally. At this instance, the communication groove 33*c* could be provided on an end surface of the cylinder main body 30 spaced from the cylinder chamber as shown in FIG. 6.

Figure 16:
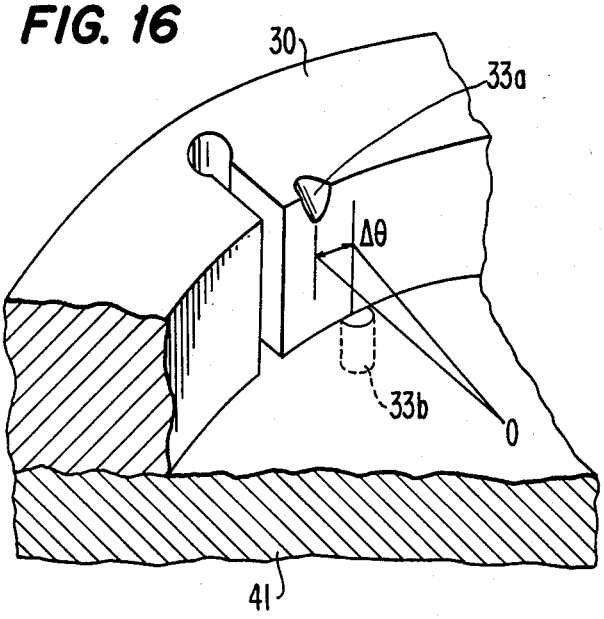
FIG. 16 is a view similar to FIG. 12, but showing a further embodiment of the invention.

Furthermore, as will be apparent from the abovedescribed embodiments, in essence it is only necessary to make the compressed fluid in the top clearance volume flow reversely in two divided occurrences at times shifted by $\Delta\theta$. Hence it will be understood that in the embodiment having a delivery port at one location, another top clearance volume, that is, a top clearance volume corresponding to the notched groove 33*b* shown in FIGS. 4, 5 and 6, could be provided in the upper bearing 40 or in the lower bearing 41 (FIG. 16) without being restricted to only the cylinder main body 30.

Figure 8:
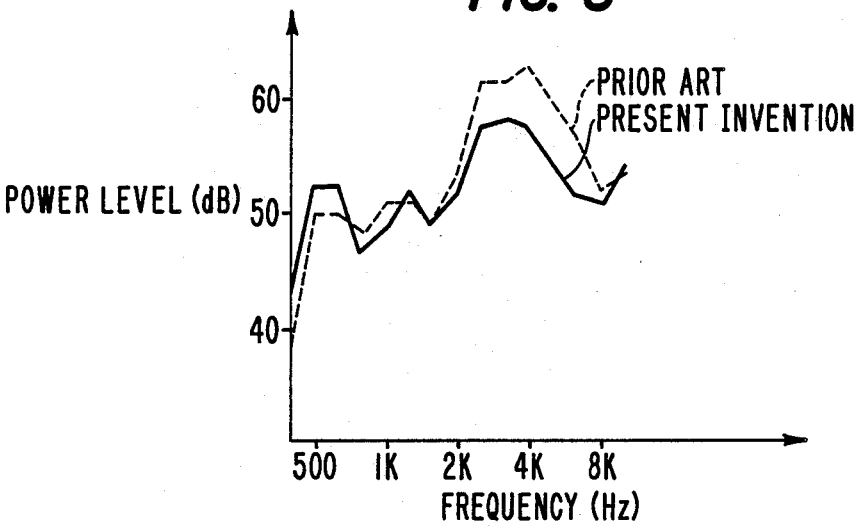
FIG. 8 is a diagram showing results of experiments conducted for reducing noise of a rotary compressor.
Figure 12:
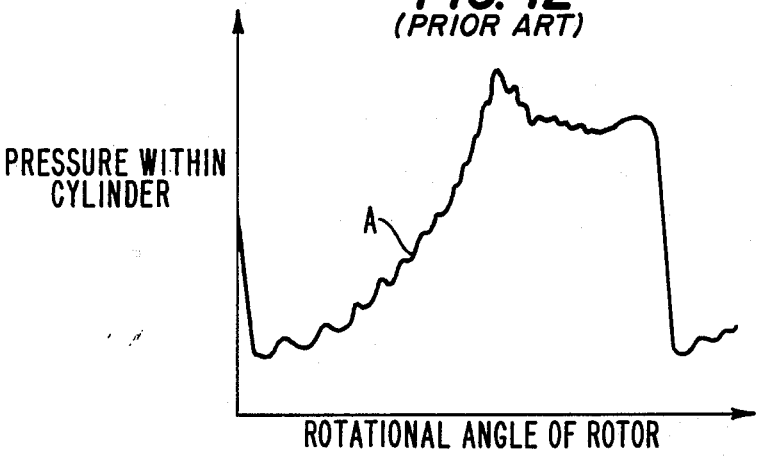
FIG. 12 (PRIOR ART)
FIG. 12 is a diagram showing a variation of a pressure within a cylinder as a function of rotational angle of a rotor.
Figure 9:
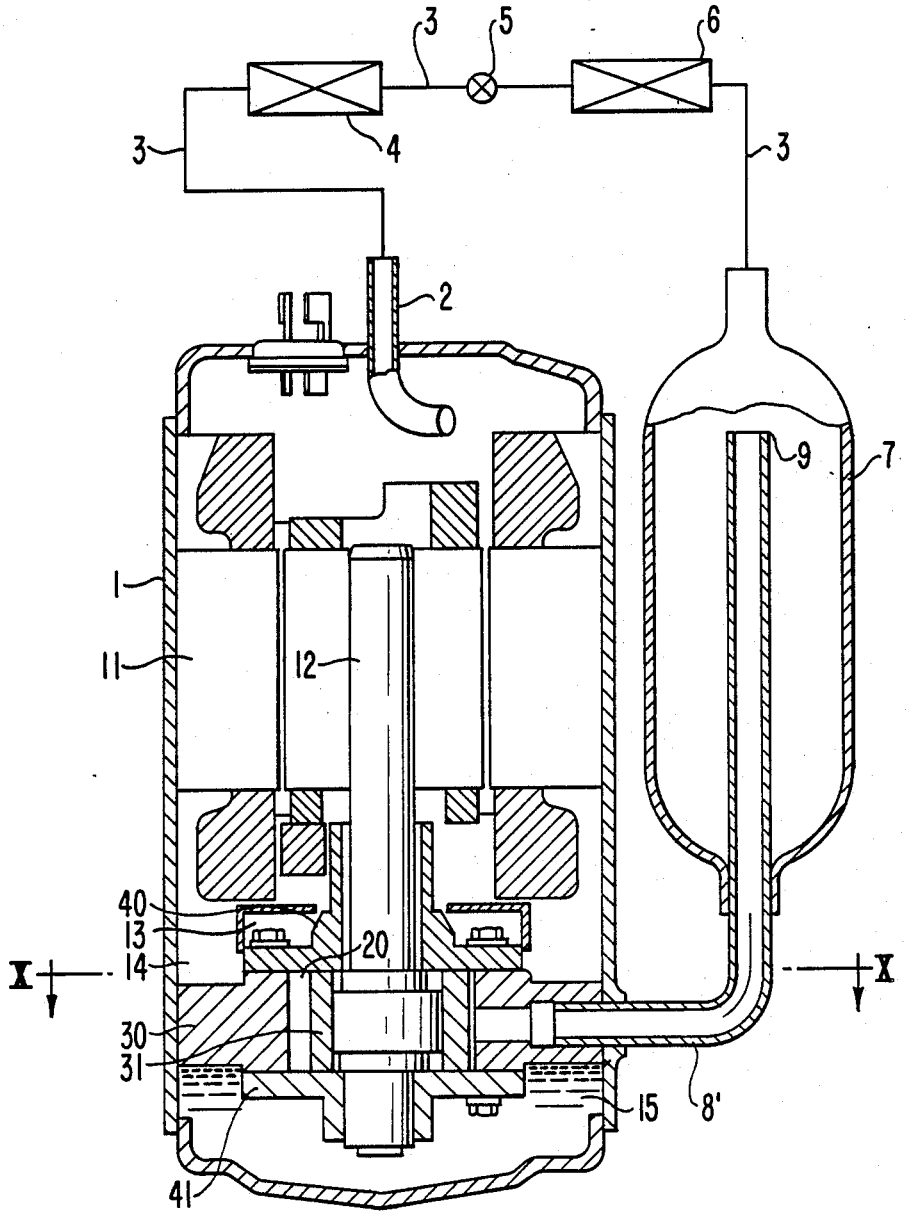
FIG. 9 (PRIOR ART)
FIG. 9 is a longitudinal cross-sectional view showing a structure of a conventional rotary compressor.
Figure 10:
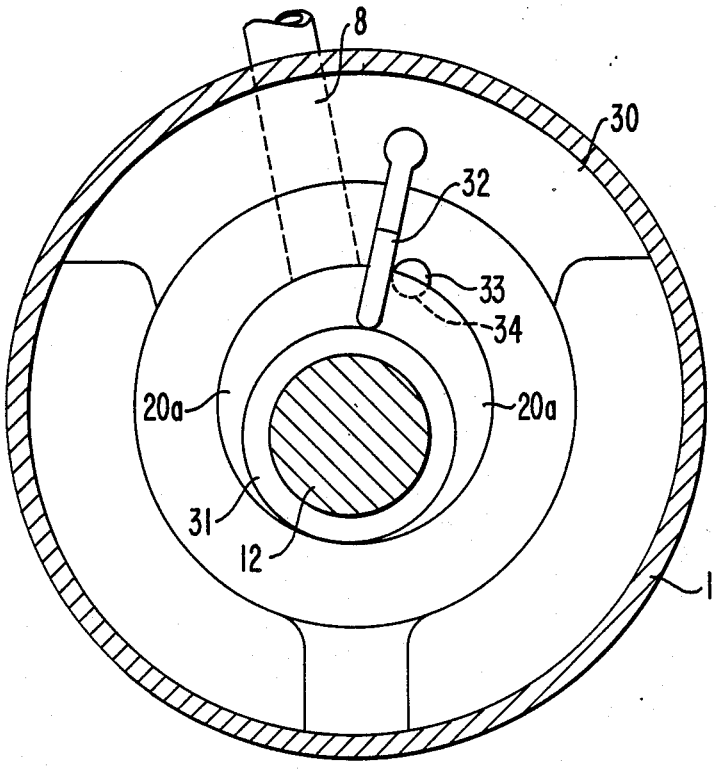
FIG. 10 (PRIOR ART)
FIG. 10 is a transverse cross-sectional view taken along line X—X in FIG. 9.
Figure 11:
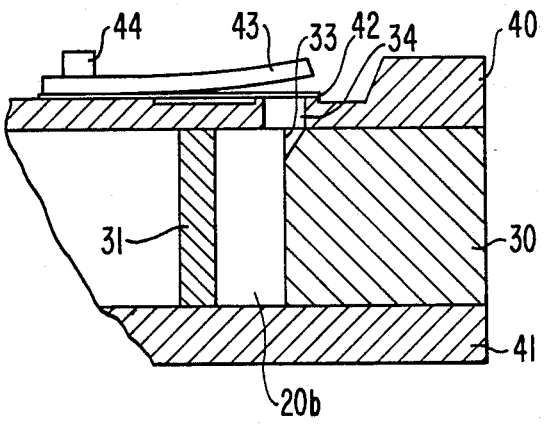
FIG. 11 (PRIOR ART)
FIG. 11 is a cross-sectional view taken through a portion 8 FIG. 10.
Figure 13:
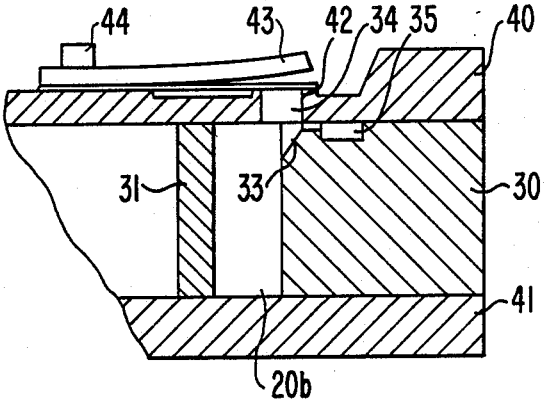
FIG. 13 (PRIOR ART)
FIG. 13 is an enlarged partial cross-sectional view showing a structure of a portion in the proximity of a delivery valve in a different example of a rotary compressor in the prior art.
Figure 14:
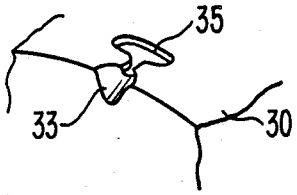
FIG. 14 (PRIOR ART)
FIG. 14 is a partial perspective view of the portion shown in FIG. 13.
Figure 15:
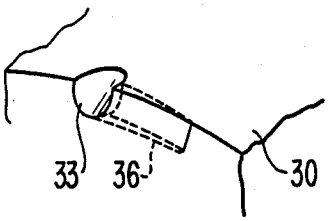
FIG. 15 (PRIOR ART)
FIG. 15 is a partial perspective view similar to FIG. 14 showing a structure of a corresponding portion in a further different example of a rotary compressor in the prior art.

As described above, with respect to at least one top clearance volume formed between a cylinder chamber and a delivery valve, another top clearance volume is provided, displaced by $\Delta\theta$, to make the compressed fluid in the top clearance volumes flow reversely into the cylinder chamber in two divided occurrences at times shifted by $\Delta\theta$. Therefore, the phases of the high frequency components of the pulsations generated within the cylinder by the reverse flow will act to offset each other and will be eliminated because, with respect to a high frequency component A of the pulsations generated by the initial reverse flow, a high frequency component B of the pulsations generated by the subsequent reverse flow is shifted by one-half cycle, that is, by 180 degrees. Accordingly, noise caused by the abovementioned pulsations can be reduced. FIG. 8 shows results of experiments conducted by means of a refrigerated compressor having a displacement of 28 cc/rev. and a capacity of 20000 BTU/H. As will be apparent from this diagram, in a high frequency range of 1 KHz or higher, noise reduction of several decibels was observed.

It is a matter of course that the present invention is not limited to roller type rotary compressors employed in the above-described embodiments but it is equally applicable to vane type and other types of rotary compressors.

As described in detail above, according to the present invention, a high frequency component of pulsations generated in a cylinder chamber by a reverse flow of compressed fluid from a top clearance volume into the cylinder chamber can be eliminated by providing another top clearance volume, producing a reverse flow of the compressed fluid from this additional top clearance volume at a shifted timing, and offsetting the first high frequency component with high frequency components of pulsations generated by the additional reverse flow of the compressed fluid, and therefore, reduction of noise caused by high frequency components of the above-mentioned pulsations can be realized.

Moreover, since the additional top clearance volume may be provided at a displaced position, lubricating oil would not fill the top clearance volume, no difficulty in machining occurs, deterioration of performance will not result, and the effect of the additional top clearance volume can be fully revealed.

Since many changes and modifications in design can be made to the above-described construction without departing from the spirit of the present invention, all matter contained in the above description and illustrated in the accompanying drawing shall be interpreted to be illustrative and not as a limitation to the scope of the invention.

What is claimed is:

1. In a rotary compressor comprising a cylinder, a rotor rotatably mounted within said cylinder, a cylinder chamber defined between said cylinder and said rotor, a partition plate dividing said cylinder chamber into a suction side space and a compression side space, an inlet to said suction side space, a delivery port leading from said compression side space to a delivery valve, whereby during rotation of said rotor fluid is introduced through said inlet to said suction side space, compressed and delivered from said compression side space through said delivery port and said delivery valve, and a groove connected to said delivery port to ensure open passage from said compression side space to said delivery port, wherein said delivery port and said groove form a first clearance volume containing fluid at the end of a delivery stroke, such fluid in said first clearance volume flowing reversely into said suction side space at the beginning of a subsequent suction stroke and generating a first pulsation having a high frequency component, the improvement comprising means for reducing noise in said compressor due to said high frequency component of said first pulsation, said means comprising:

a second clearance volume displaced from said first clearance volume and provided at a position in communication with said cylinder chamber to receive fluid therefrom at the end of the delivery stroke, such that the fluid within said second clearance volume flows reversely into said suction side space at the beginning of the subsequent suction stroke and thereby generates a second pulsation separate from said first pulsation and having a high frequency component in a manner to offset said high frequency component of said first pulsation, said second clearance volume being positioned at a location such that said second pulsation is phase-shifted by one-half cycle with respect to said high frequency component of said first pulsation.

2. The improvement in claim 1, wherein said second clearance volume is positioned upstream of said first clearance volume relative to the direction of rotation of said rotor.

3. The improvement claimed in claim 1, wherein said second clearance volume comprises a second groove and a second delivery port leading to a second delivery valve on an axial end of said cylinder chamber opposite the first mentioned delivery valve.

4. The improvement claimed in claim 1, wherein said second clearance volume is located at the same axial end of said cylinder chamber as said first clearance volume.

5. The improvement claimed in claim 4, further comprising a groove connecting said first and second clearance volumes.

6. The improvement claimed in claim 1, wherein said second clearance volume is formed by a groove in said cylinder.

7. The improvement claimed in claim 1, wherein said second clearance volume is formed in an end member closing an axial end of said cylinder chamber.

* * * * *